US008092923B2

(12) United States Patent
Thamida

(10) Patent No.: US 8,092,923 B2
(45) Date of Patent: Jan. 10, 2012

(54) CORROSION RESISTANT SPACER

(75) Inventor: Sunil K. Thamida, Karnataka (IN)

(73) Assignee: GM Global Technology Operations LLC, Detroit, MI (US)

( * ) Notice: Subject to any disclaimer, the term of this patent is extended or adjusted under 35 U.S.C. 154(b) by 1017 days.

(21) Appl. No.: 11/954,439

(22) Filed: Dec. 12, 2007

(65) Prior Publication Data

US 2009/0155616 A1 Jun. 18, 2009

(51) Int. Cl.
*B32B 15/04* (2006.01)

(52) U.S. Cl. ..... 428/686; 428/610; 428/649; 428/650; 428/654

(58) Field of Classification Search ..... None
See application file for complete search history.

(56) References Cited

U.S. PATENT DOCUMENTS

| | | | | |
|---|---|---|---|---|
| 5,455,000 | A | 10/1995 | Seyferth et al. | |
| 6,037,066 | A | 3/2000 | Kuwabara | |
| 6,123,898 | A | 9/2000 | Taimatsu et al. | |
| 6,129,143 | A * | 10/2000 | Hasegawa et al. | 165/133 |
| 7,074,348 | B2 | 7/2006 | Geer et al. | |
| 2004/0045643 | A1 * | 3/2004 | Hewett et al. | 148/535 |
| 2006/0130709 | A1 | 6/2006 | Miksic et al. | |
| 2010/0143746 | A1 * | 6/2010 | Song et al. | 428/636 |

FOREIGN PATENT DOCUMENTS

JP 63262439 A * 10/1988

OTHER PUBLICATIONS

Shi,Z; Influence of the Beta-phase on the corrosion performance of anodised coatings on Mg-Al alloys; Corrosion Science; 2005; pp. 2760-2777; 47; Elsevier Ltd; www.elsevier.com.

* cited by examiner

*Primary Examiner* — Aaron Austin

(57) ABSTRACT

An interface device is provided that is insertable at a junction between a first device comprising a first metal and a second device comprising a second metal that is dissimilar to the first metal. The interface device comprises at least one layer comprising an alloy of the first metal and the second metal and having a functionally gradient composition operative to reduce a galvanic effect between the first and second devices.

12 Claims, 3 Drawing Sheets

CORROSION RESISTANT SPACER

TECHNICAL FIELD

The present disclosure generally relates to corrosion resistance at a bi-metal junction.

BACKGROUND

The statements in this section merely provide background information related to the present disclosure and may not constitute prior art.

Corrosion can occur at a junction between devices formed of dissimilar metals due to galvanic action. In general, at a junction between dissimilar metals, the metal with a more negative potential corrodes preferentially. By way of example, when a device formed of magnesium is in physical contact with a device formed of aluminum in the presence of a corroding environment, e.g., an electrolyte such as salt, the magnesium device corrodes near the junction. This is known as galvanic corrosion. Galvanic corrosion occurs because the corrosion electric potential of magnesium is about −1.6 volts while that of aluminum is about 0.8 volts. Hence, the magnesium device becomes an anode, the aluminum device becomes a cathode, and there is a current exchange including dissolution of the metal on the anode (magnesium) side.

A known way to protect such type of galvanic corrosion in metals is to provide electrical insulation between the two devices. But insulating materials like gaskets are not readily employable in certain applications, e.g., an automotive engine cradle subject to high temperatures and adverse loading conditions.

A liquid galvanic coating for protection of embedded metals has been proposed, wherein a fluid galvanic coating for protecting corrosion-susceptible materials is embedded within a substrate. The coating includes one or more metals selected from the group consisting of magnesium, zinc and alumina or more elements and/or one or more additives selected from the group consisting of conductive polymers, carbon fibers and graphite.

Another proposed manner of protecting embedded corrosion-susceptible materials requires coating of an overall structure with a conductive paint and applying current by the use of an external power supply. Such systems are costly to install, require a continuous power supply and must be periodically monitored and maintained throughout the life of the structure. Sacrificial cathodic protection methods typically require the application of metallic zinc.

Another proposed method includes applying a coating that acts as an electrolytic barrier and a cathodic corrosion prevention system, applicable to ferrous and non-ferrous metal substrates. The method provides cathodic protection from corrosion by coating with polymers and sacrificial anodic metal particles. This coating system is formed by a process that includes premixing of an inherently conductive polymer with anodic metal particles to form an inherently conductive polymer/metal particle complex.

Another proposed method to protect metals from corrosion uses a type of coating called barrier coating. Barrier coatings function to separate metal from the surrounding environment. Some examples of barrier coating include paint and nickel and chromium plating.

Another type of coating used to protect metal is called sacrificial coating. The metal is coated with a material that reacts with the environment and is consumed in preference to the substrate it protects. These coatings may be further subdivided into chemically reactive, e.g., chromate coatings and electrochemically active or galvanically active, e.g., aluminum, cadmium, magnesium and zinc. The galvanically active coatings must be conductive and are commonly called cathodic protection.

There can be difficulty in creating a coating that protects like a cathodic system but is applied with the ease of a typical barrier coating system. Furthermore, there are environmental considerations related to plating operations and surface preparation for certain top coating processes.

Metallic spacers have been used in automobiles. In one example, an aluminum spacer has been placed between magnesium and steel, creating a junction consisting of magnesium-aluminum-steel. This junction generates electrochemical corrosion potentials of Mg: −1.6V/Al: −0.8V/Fe: −0.2V. The electrochemical corrosion potentials suggest that if the corrosion potential of a spacer has an intermediate value of the other components of the junction, then the galvanic corrosion is reduced. It has been found that a single alloy spacer is not substantially effective in preventing galvanic corrosion, particularly in automotive components formed of magnesium and exposed to high temperature operating environments.

SUMMARY

The present disclosure sets forth an interface device insertable at a junction between a first device comprising a first metal and a second device comprising a second metal that is dissimilar to the first metal. The interface device comprises at least one layer comprising an alloy of the first metal and the second metal and having a functionally gradient composition operative to reduce the galvanic effect between the first and second devices.

BRIEF DESCRIPTION OF THE DRAWINGS

One or more embodiments will now be described, by way of example, with reference to the accompanying drawings, in which.

DETAILED DESCRIPTION

Figure 1:
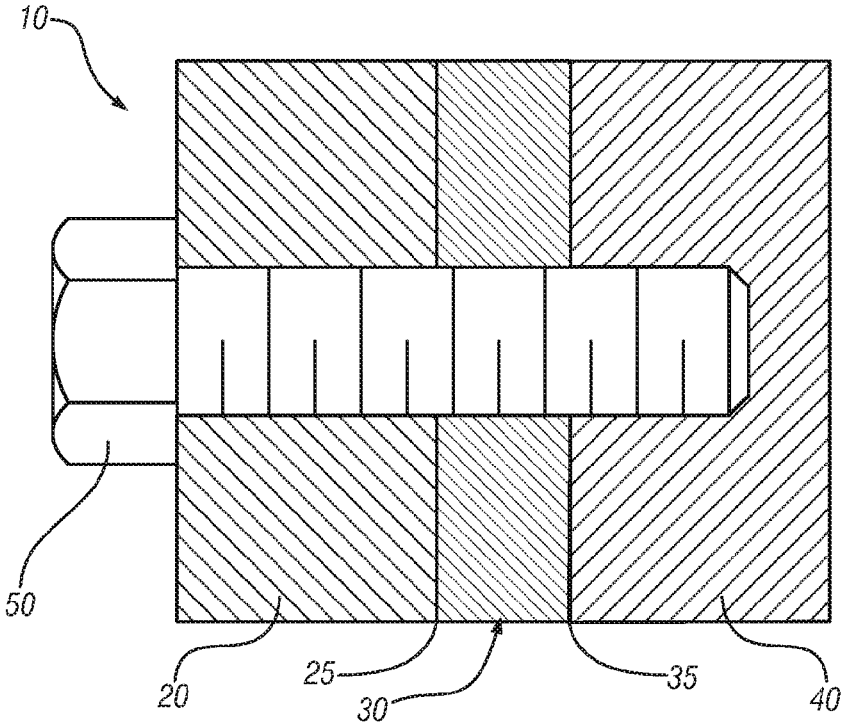
FIG. 1 is a schematic illustration, in accordance with the present disclosure.

Referring now to the drawings, wherein the showings are for the purpose of illustrating certain exemplary embodiments only and not for the purpose of limiting the same, FIG. 1 schematically illustrates a junction 10 of devices of dissimilar metals that has been constructed in accordance with an embodiment of the disclosure. The junction 10 includes a first device 20 and a second device 40, with an interface device 30 inserted therebetween. The junction 10 as depicted is secured via a fastener 50, depicted as a pass-through bolt which compressively connects the first device 20, the interface device 30, and the second device 40. A first subjunction 25 is formed between the first device 20 and the interface device 30, and a second subjunction 35 is formed between the interface device 30 and the second device 40.

The first device 20 is formed from a first metal, in this embodiment comprising aluminum (also referred to herein by its element symbol Al). Aluminum has a corrosion potential of approximately −0.8V. The second device 40 is formed from a second metal dissimilar to the first metal, in this embodiment comprising magnesium (also referred to herein by its element symbol Mg). Magnesium has a corrosion potential of approximately −1.6V. The interface device 30 is formed from bimetallic alloys of the first metal and the second metal, i.e., Al and Mg.

The interface device 30 comprises a spacer composed of a plurality of layers 32, with each layer 32 formed from a bimetallic alloy of the first and second metals. The alloys of the layers 32 of the interface device 30 are formed to effect a functionally gradient composition with regard to galvanic current densities generated at the first subjunction 25 and the second subjunction 35. The layers 32 are preferably composed in a gradation of the alloys to achieve a galvanic current distribution which minimizes an effective galvanic current peak at the one of the first and second subjunctions 25 and 35 between the interface device 30 and the one of the first and second devices 20 and 40 formed from the one of the first and second metals having the lower corrosion potential. The gradation of alloy composition of the layers 32 can be achieved by forming the layers with varying alloy compositions such that the layer 32 adjoining the first device 20 comprises an alloy having a relative maximum percentage of the first metal and the final layer adjoining the second device 40 comprises an alloy having a relative minimum percentage of the first metal. Preferably, the each of the aforementioned alloys of the interface device 30 is composed such that the one of the first and second metals having the lower corrosion potential predominates. Thus, in the first embodiment described hereinbelow with reference to FIG. 2, the layers 32 are formed from Mg—Al alloys in gradations which minimize galvanic peak current at the second subjunction 35 between the interface device 30 and the second device 40 formed from magnesium, which has a lower corrosion potential than aluminum.

Figure 2:
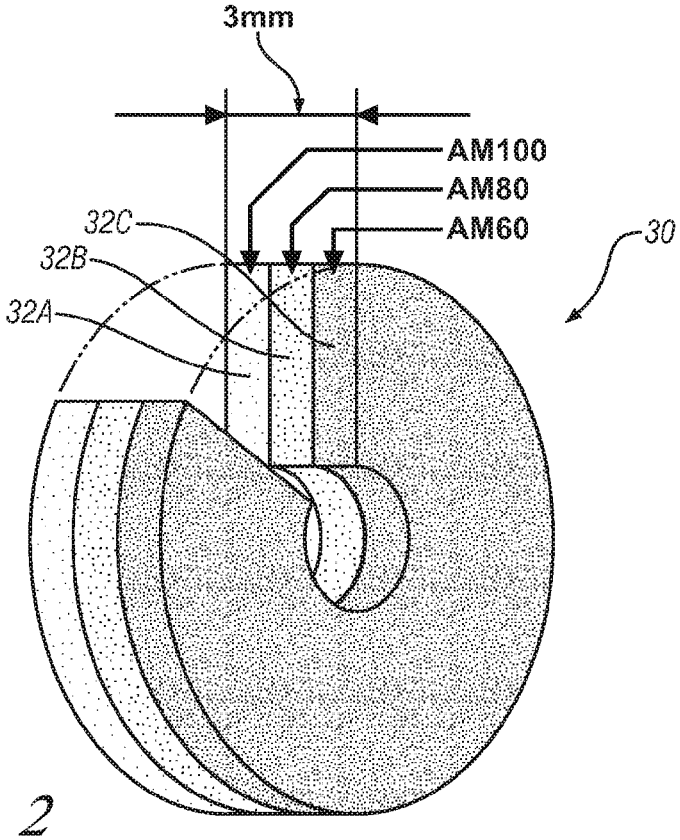
FIG. 2 is a schematic illustration, in accordance with the present disclosure.

FIG. 2 schematically depicts an embodiment of the interface device 30 constructed of three layers 32, depicted herein as a first layer 32A, a second, intermediate layer 32B, and a third layer 32C. The first layer 32A adjoins the first device 20 at the first subjunction 25. The third layer 32C adjoins the second device 40 at the second subjunction 35. The layers 32A, 32B, and 32C are formed from bimetallic alloys of the first and second metals, with a gradation in the composition thereof. As depicted, the first layer 32A is formed from an alloy referred to as AM100, comprising 10%-Al/90%-Mg. The second layer 32B is formed from an alloy referred to as AM80, comprising 8%-Al/92%-Mg. The third layer 32C is formed from an alloy referred to as AM60, comprising 6%-Al/94%-Mg. In this embodiment, each of the layers 32A, 32B, and 32C is approximately 1.0 mm thick, with the interface device 30 having a total thickness of approximately 3.0 mm. The interface device 30 can be produced by joining alloy sheets formed from materials of the multiple layers 32A, 32B, and 32C using a hot-rolled process analogous to metal cladding or by another process. Alternatively, the interface device 30 can be composed of various quantities of layers 32, e.g., a single layer, two layers, four layers, of varying alloys of the first and second metals to achieve a gradation of composition of the layers 32 to achieve a galvanic current distribution which minimizes an effective galvanic current peak at the one of the first and second subjunctions 25 and 35 between the interface device 30 and the one of the metals having lower corrosion potential, taking into account other factors, e.g., physical space requirements, application environment, and service life.

Figure 3:
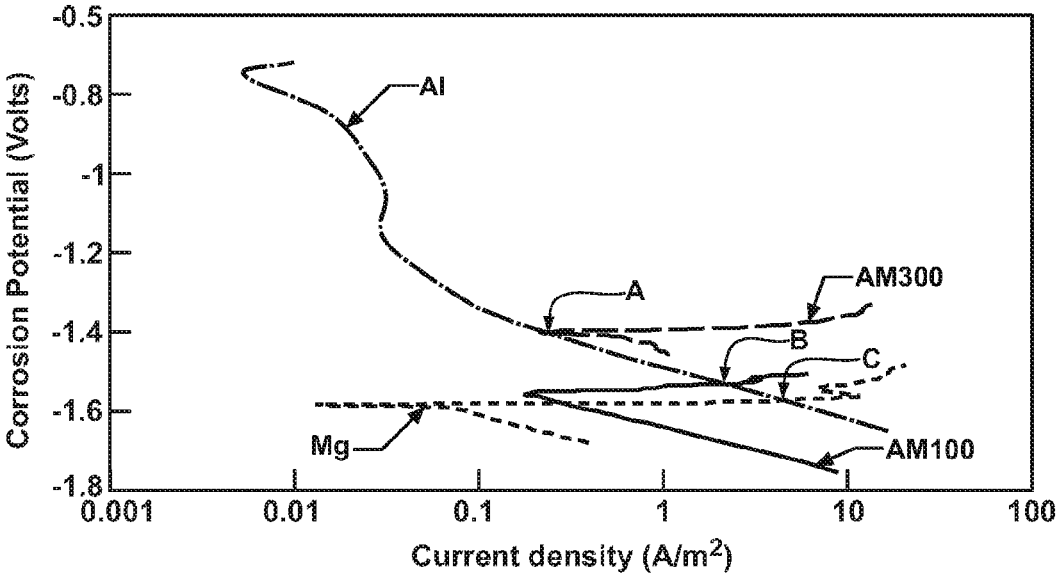
FIGS. 3-5 are datagraphs, in accordance with the present disclosure.

FIG. 3 graphically depicts corrosion potentials (Volts) and galvanic current densities ($A/m^2$) for a plurality of exemplary metal and bimetal alloy compositions, including intersections A, B, and C occurring therebetween. The compositions include aluminum (depicted as 'Al'), magnesium (depicted as 'Mg'), an alloy comprising 10%-Al/90%-Mg (depicted as 'AM100'), and, an alloy comprising 30%-Al/70%-Mg (depicted as 'AM300'). The data indicate that intersection A formed between Mg and Al yields a maximum galvanic current density, as compared to intersection B formed between Al and AM100, and intersection C formed between Al and AM300. The results indicate that galvanic current density decreases at an intersection between a device formed of Al and an interface device 30 composed of an alloy comprising Al/Mg.

Figure 4:
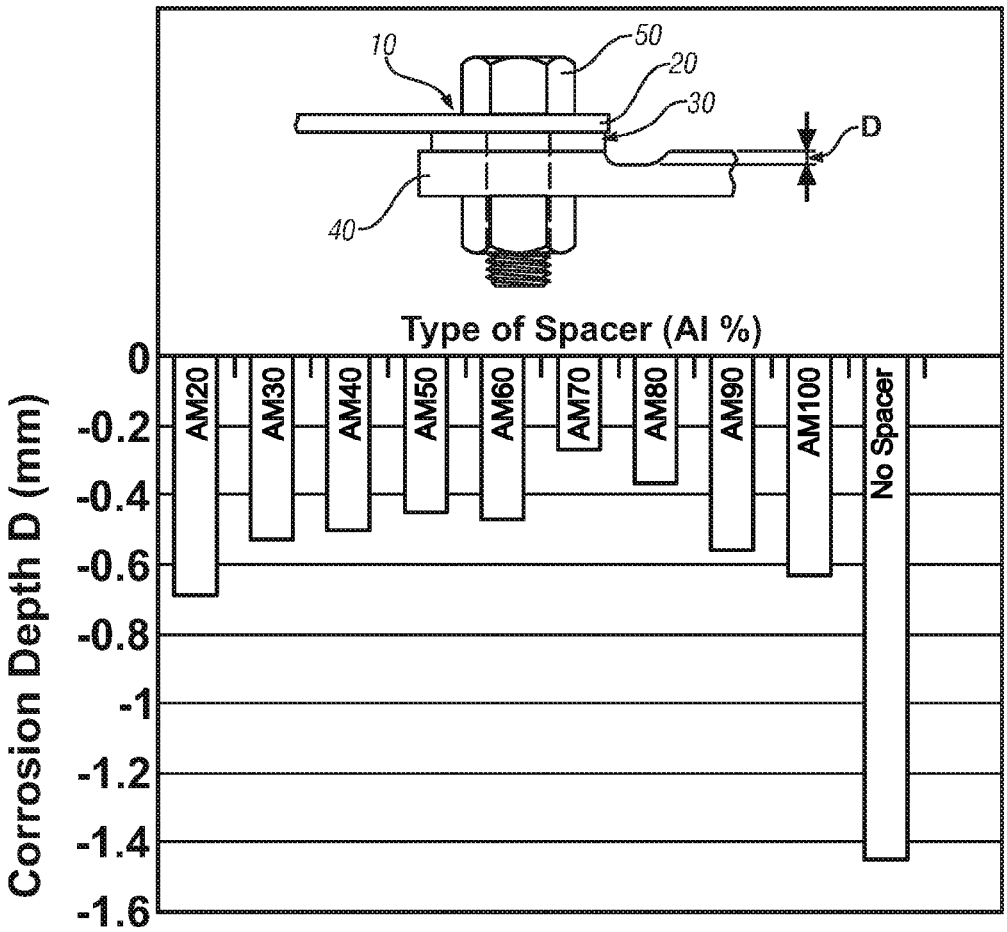

FIG. 4 graphically depicts experimental results for alternate embodiments. The use of similar numerals indicates use of similar devices as have been previously described. In the experimental system, several junctions 10 were constructed, comprising the first device 20, the interface device 30, and the second device 40. In this embodiment, the first device 20 is formed from steel, having a corrosion potential of approximately −0.2V, and the second device 40 is formed from magnesium having a corrosion potential of approximately −0.8V. A plurality of interface devices 30 were constructed, formed from a single Mg—Al layer 32. A junction consisting of only the first device 20 and the second device 40 (not shown) was also constructed. Each of the constructed junctions was tested for galvanic corrosion using a galvanic corrosion test. Test results of the galvanic corrosion test comprise a corrosion depth D in the second device 40 proximal to the junction 10, compared to a pre-test depth (nominally 0.0 mm). Each of the interface devices 30 comprised a single layer 32 composed of alloys of aluminum ('Al') and magnesium ('Mg'), compositions including 2%-Al/98%-Mg ('AM20'), 3%-Al/97%-Mg ('AM30'), 4%-Al/96%-Mg ('AM40'), 5%-Al/95%-Mg ('AM50'), 6%-Al/94%-Mg ('AM60'), 7%-Al/93%-Mg ('AM70'), 8%-Al/92%-Mg ('AM80'), 9%-Al/91%-Mg ('AM90'), and 10%-Al/90%-Mg ('AM100'). The test results indicate that the interface device 30 composed of 7%-Al/93%-Mg ('AM70') yielded a minimum corrosion depth D for the compositions tested.

Figure 5:
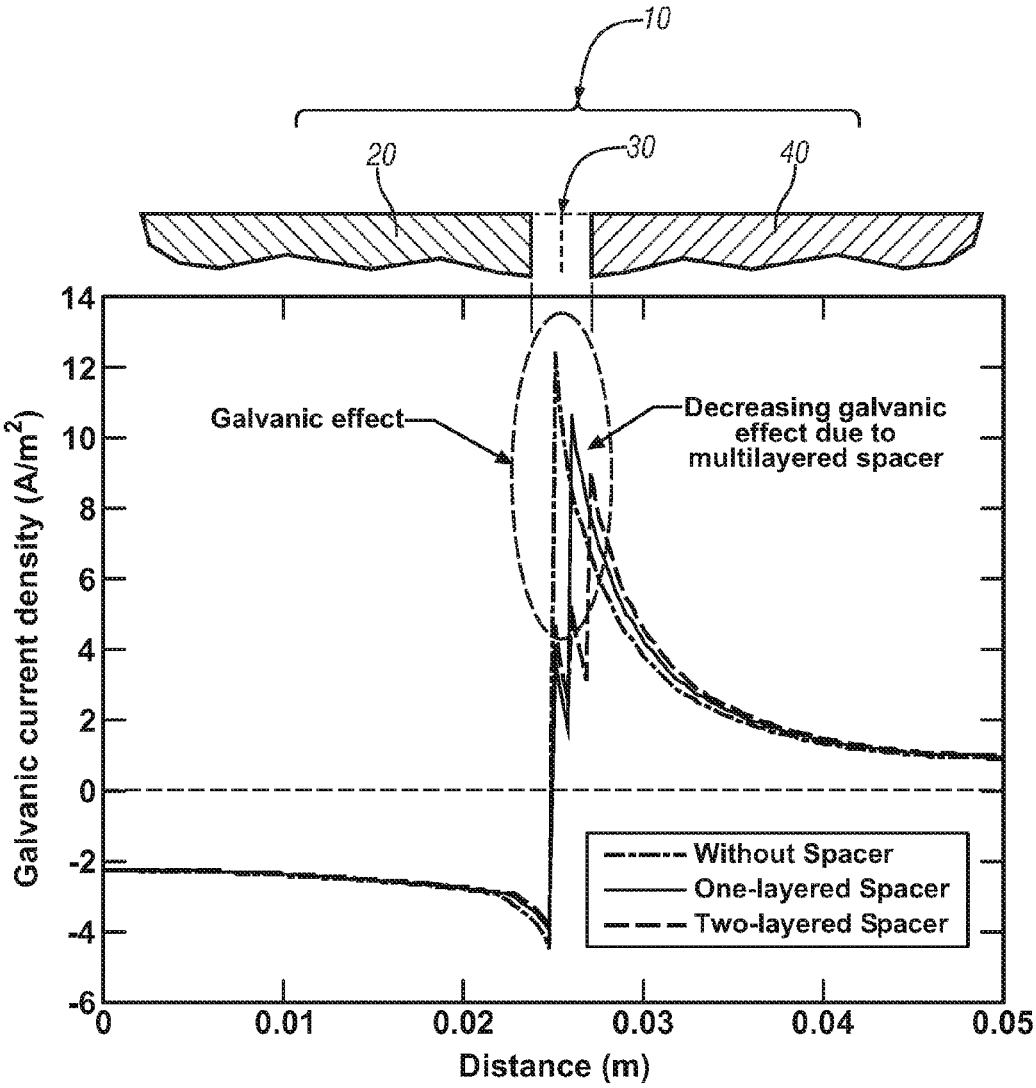

FIG. 5 graphically depicts magnitude of galvanic current density occurring at the junction 10 between the first device 20, composed of Al, and the second device 40, composed of Mg plotted against a linear distance, in meters (m), from the junction 10. The graphically depicted data was generated using known mathematical modeling and simulation techniques. Data for the galvanic current density is shown for the junction 10 having the interface device 30 comprising a single layer composed of an alloy of Al—Mg ('One-layered Spacer'), and junction 10 having the interface device 30 comprising two layers composed of different Al—Mg alloys ('Two-layered Spacer'), and a junction 10 having no interface device ('Without Spacer'). The results indicate a decrease in galvanic current density at the second device 40 when using the interface device 30 comprising the two layers composed of different Al—Mg alloys. The corrosion potential and galvanic current density of the interface device 30 to achieve a functionally gradient composition with regard to galvanic current densities can be determined by modeling and numerical simulation, and is applicable to various combinations of first and second devices 20 and 40 composed of dissimilar metals, e.g., magnesium, aluminum, and steel.

It is understood that all references to specific metals and alloys are meant to be exemplary as descriptive embodiments of the disclosure, and not limiting. The disclosure has described certain preferred embodiments and modifications thereto. Further modifications and alterations may occur to others upon reading and understanding the specification. Therefore, it is intended that the disclosure not be limited to the particular embodiment(s) disclosed as the best mode contemplated for carrying out this disclosure, but that the disclosure will include all embodiments falling within the scope of the appended claims.

The invention claimed is:

1. A junction of a first device and a second device, comprising:

a first device comprising a first metal;

a second device comprising a second metal dissimilar to the first metal;

a spacer between the first and second devices, said spacer interfacing with the first device to form a first subjunction and interfacing with the second device to form a second subjunction;

said spacer comprising a plurality of layers, wherein each layer comprises a respective alloy of the first metal and the second metal; and wherein the layers are arranged to provide a gradation of the respective alloys such that the layers closer to the first device have higher concentrations of the first metal than the layers further from the first device and layers closer to the second device have higher concentrations of the second metal than the layers further from the second device.

2. The junction of claim 1, wherein the respective alloys are configured to reduce a galvanic current peak at the one of the first subjunction and the second subjunction corresponding to the one of the first and second metals having a lower corrosion potential.

3. The junction of claim 2:

wherein the first metal has a higher corrosion potential than the second metal;

wherein the plurality of layers comprises a first layer interfacing with the first device wherein the respective alloy has a relative maximum percentage of the first metal, and a second layer interfacing with the second device wherein the respective alloy has a relative minimum percentage of the first metal; and wherein the second metal predominates the first metal in each respective alloy.

4. The junction of claim 1, wherein the first metal comprises aluminum and the second metal comprises magnesium and the alloy comprises aluminum and magnesium.

5. The junction of claim 4, wherein the plurality of layers comprises:

a first layer interfacing with the first device comprising a magnesium-aluminum alloy having a relative maximum percentage of aluminum, a second layer interfacing with the second device comprising a magnesium-aluminum alloy having a relative minimum percentage of aluminum, and a third layer intermediate the first and second layers comprising a magnesium-aluminum alloy having a relative percentage of aluminum that is between said relative minimum and relative maximum percentages of aluminum; and wherein magnesium predominates aluminum in each respective alloy.

6. The junction of claim 5, wherein the first layer comprises about 10% aluminum and about 90% magnesium, the third layer comprises about 8% aluminum and about 92% magnesium, and the second layer comprises about 6% aluminum and about 94% magnesium.

7. The junction of claim 1, wherein the first metal consists essentially of aluminum and the second metal consists essentially of magnesium.

8. An interface device insertable at a junction between a first device comprising aluminum and a second device comprising magnesium, comprising:

a plurality of layers having a functionally gradient composition configured to reduce a galvanic effect between the first and second devices, including a first layer adjoining the first device comprising a magnesium-aluminum alloy having a relative maximum percentage of aluminum, an intermediate layer, and a final layer comprising a magnesium-aluminum alloy having a relative minimum percentage of aluminum; and wherein the first layer comprises about 10% aluminum and about 90% magnesium, the intermediate layer comprises about 8% aluminum and about 92% magnesium, and the final layer comprises about 6% aluminum and about 94% magnesium.

9. A junction of a first device and a second device, comprising:

a first device comprising a first metal;

a second device comprising a second metal dissimilar to the first metal;

alloys of the first metal and the second metal; and the alloys arranged in a gradation of composition between the first and second devices to effect a functionally gradient composition to reduce a galvanic effect between the first and second devices.

10. The junction of claim 9, wherein the alloys arranged in the gradation of composition between the first and second devices minimize a galvanic current peak at an interface with the one of the first and second metals having a lower corrosion potential.

11. The junction of claim 10:

wherein the first metal has a higher corrosion potential than the second metal; and wherein the alloys arranged in a gradation of composition between the first and second devices comprises a plurality of layers, comprising a first layer adjoining the first metal comprising an alloy having a relative maximum percentage of the first metal, and a second layer adjoining the second metal comprising an alloy having a relative minimum percentage of the first metal.

12. The junction of claim 11, wherein the second metal is dissimilar to the first metal based upon corrosion electric potentials of the first and second metals.

* * * * *